United States Patent [19]

Lawhead

[11] 3,958,572

[45] May 25, 1976

[54] BLOOD COLLECTING AND SEPARATING ASSEMBLY STOPPER

[75] Inventor: Creighton M. Lawhead, Corning, N.Y.

[73] Assignee: Corning Glass Works, Corning, N.Y.

[22] Filed: Dec. 16, 1974

[21] Appl. No.: 532,828

[52] U.S. Cl. ..... 128/272; 215/247; 215/320

[51] Int. Cl.[2] ..... A61J 1/00

[58] Field of Search ..... 128/213, 214 B, 214 D, 128/2 F, 2 G, 215–217, 218 R, 218 M, 218 D, 218 DA, 220, 272, 275–276, 297; 215/247, 355, 296, DIG. 3, 320

[56] References Cited

UNITED STATES PATENTS

| | | | |
|---|---|---|---|
| 2,607,347 | 8/1952 | Kleiner | 128/276 |
| 2,812,231 | 11/1957 | Zar | 128/272 X |
| 2,848,130 | 8/1958 | Jesnig | 215/247 X |
| 3,136,440 | 6/1964 | Krug et al. | 215/247 |
| 3,141,460 | 7/1964 | Tsochatzopoulos | 128/276 |
| 3,330,281 | 7/1967 | Visser | 128/272 |
| 3,343,699 | 9/1967 | Nicko | 215/247 |
| 3,869,059 | 3/1975 | Ellis | 215/320 |

FOREIGN PATENTS OR APPLICATIONS

| | | | |
|---|---|---|---|
| 724,915 | 1955 | United Kingdom | 128/272 |
| 407,559 | 1934 | United Kingdom | 128/220 |

*Primary Examiner*—John D. Yasko
*Attorney, Agent, or Firm*—Thomas J. McNaughton; Burton R. Turner; Clarence R. Patty, Jr.

[57] ABSTRACT

A stopper for use with an evacuated blood collecting and separating tube comprising a flange portion, a plug portion depending from the flange portion including a generally frustoconical lateral face and a flat annular bottom face, and a nose portion depending from an inner circumference of the plug bottom face. The nose portion includes a beveled or tapered section having an axial cavity extending through the nose portion into the plug portion. The axial cavity preferably includes a frustoconically shaped lateral face.

2 Claims, 4 Drawing Figures

BLOOD COLLECTING AND SEPARATING ASSEMBLY STOPPER

BACKGROUND OF THE INVENTION

1. Field of the Invention

This invention relates to blood collecting and separating tube assemblies and more particularly to puncturable stoppers used to form a vacuum-tight and liquid-tight seal within the open end of a blood collecting and separating tube.

2. Prior Art

Evacuated tubes have been used to collect and separate blood for some 20 years. The conventional tube assemblies include a cylindrical container or tube having a closed end and an open end vacuum sealed by means of a removable needle-pierceable stopper or closure. Typically blood is withdrawn from a patient by first puncturing a vein with one end of the double-ended needle and then while firmly securing the housing holding the needle, pushing the needle pierceable closure of a collection tube against the other end of the needle until the closure is pierced. The partial vacuum within the collection tube results in siphoning or withdrawing blood into the tube. After the desired volume of blood is drawn into the tube, the needle is withdrawn from the patient. An example of a conventional blood collecting and separating tube is described in U.S. Pat. No. 2,460,641.

The standard venipuncture procedure is usually accomplished with the stoppered end of the container being held downwardly. Accordingly, as blood is siphoned into the tube, the blood will rest against the inner surface of the stopper, that is, at the bottom end of the stopper. After venipuncture, it has been found that with known container assemblies a small portion of the blood remains attached to the bottom end of the stopper and also between the stopper and container walls.

The major failing of the standard stopper, from the user standpoint, is its retention of a substantial portion of clotted blood or cells at the stopper-container wall juncture even upon completion of the centrifugation of the blood. This failing makes it highly desirable, if not essential, to remove the stopper before centrifugation and clean (using a swab or stick) the clot or cells from the top inside wall of the tube.

Merely removing the stopper without cleaning the residual ring-clot or cells will not overcome the problem, since centrifugal force does not remove the unwanted attachment of clot or cells from the tube wall because of the drying onthe wall that begins to occur just after the stopper is removed or "popped". This drying and adhering of clot or cells on the tube wall has been found to be aggravated during centrifugation both by turbulent air action and by rising temperatures within the centrifuge, throughout the duration of the spin, which is typically, eight to twelve minutes. Cleanliness of the tube wall after centrifugation is highly desirable because most serum is poured from the tube, and attached cells can thus be eluted by the pouring of the serum or plasma.

Under present practices requiring the removal of the stopper prior to centrifugation, a period of up to three hours may elapse between centrifugation and serum or plasma utilization, during which time the blood sample is open to the atmosphere and evaporation of gaseous blood constituents may take place. The net result may be an increase in the apparent concentration of some blood constituents and a decrease in the apparent concentration of the gaseous constituents, which produces a deviation from the true clinical values of serum or plasma chemistries for the patient in question.

Also while the unstoppered tube is standing in a rack waiting to be analyzed, particulate matter and other airborne contaminants, as well as splashed reagents or splashed serum from other tubes (occurring when tubes are hastily put into a common rack), can readily contaminate the blood sample prior to analysis.

The over-riding concern with blood collecting and separating tube assemblies which require stopper removal is, however, the potential hazard to laboratory personnel. The removal of the stopper, the rimming with a stick or swab to remove the ring clot, the aerosol effect created by the centrifuge rotation, and the possibility of accidental spillage all jeopardize the well-being of laboratory workers.

Also since cells trapped between the stopper and the tube walls may be ruptured when the stopper is removed, which results in the exuding of lactic dehydrogenase (LDH), falsely elevated LDH levels in the serum or plasma analysis may be produced.

Accordingly, it is an object of this invention to provide a stopper for use in combination with a blood collecting and separating container which will overcome the disadvantages of prior stoppers.

Also it is an object of this invention to provide a stopper which is easily insertable and removeable from a blood collecting and separating tube, and yet which maintains an adequate vacuum-tight seal for a prolonged storage time.

It is a further object of this invention to furnish a stopper of such a construction that the entire circumferential junction of the stopper and tube inner face is maintained in a fluid tight configuration to preclude the possibility of blood portions from being lodged between the stopper and tube wall.

Another object of this invention is to provide a stopper having a bottom axial cavity configuration which causes blood adhering within the cavity to flow from the cavity during an angle-head mode of centrifugation.

It is also a major object of this invention to provide a stopper suitable for use with a closed-system blood collecting and separating assembly having either a gel-like barrier material initially positioned at the closed end of the tube, such as the assembly disclosed in U.S. Pat. No. 3,852,144 or a resilient spool barrier means initiallly positioned adjacent the stoppered end of the tube, as described in U.S. Pat. No. 3,814,248. The closed-system assembly may be used to collect blood, centrifugally separate blood into at least two phases, and automatically partition the separated phases with the gel-like barrier material and/or the spool. To assure that the separated phase above the barrier, which may be serum or plasma, is not contaminated before or during pour-off of such phase, it is important that no blood constituents remain in the vicinity of the juncture of the stopper and tube wall or in an axial cavity in the bottom of the stopper upon completion of centrifugation, and the stopper of the present invention not only inhibits the formation of ring clotting but also facilitates the removal of such constituents during centrifugation.

SUMMARY OF THE INVENTION

In accordance with the present invention, the above stated objects are achieved by providing, in combination, a tubular container or tube having a cylindrical wall which is closed at one end and open at the other end, the open end lying in a plane normal to the axis of the cylindrical wall; and a stopper symmetrical about a centerline or axis comprising a flange portion, a plug portion having a frustoconical outer periphery or lateral face extending downwardly from the flange portion, and a radially recessed nose portion projecting downwardly from the plug portion and having an axial cavity formed therein. The flange portion has a flat bottom annular band or face adjoining an upper circumference of the plug portion, with the flange bottom band lying in a plane normal to the stopper centerline. The plug portion has a bottom annular band or face lying in a plane normal to the stopper centerline, that is, parallel to the flange bottom face. The outer circumference or edge of the plug bottom band has a diameter greater than the inner diameter of the tube wall to form a liquid-tight seal with the inner surface of the tube wall. When the stopper is fully inserted into the tube, the flange portion abuts the open end of the tube, with the entire outer circumference of the plug bottom band forming a fluid-tight seal with the tube; and since the plug and flange bottom bands are parallel, the plane of the plug bottom face is approximately normal to the adjacent inner surface of the tube cylindrical wall.

The nose portion connects with or extends from the plug portion at an inner circumference of the plug portion bottom hand and thus, upon insertion of the stopper into a tube, the nose portion is spaced apart from the tube inner surface by the width of the plug bottom band. The nose portion includes a beveled or frustoconical outer peripheral face section which preferably joins the inner circumference of the plug bottom band by means of a short cylindrical section or by a first inwardly rounded section and a second outwardly rounded portion adjoining a lower circumference of the first rounded section.

The nose portion includes a bottom-open axial cavity which may be formed in a bottom surface or in the frustoconical face section of the nose portion. In both embodiments, the bottom-open axial cavity preferably includes a lateral inwardly and upwardly tapered or frustoconical face designed to flow blood portions from the cavity.

In order to assure squareness of sealing of the stopper within the tube, the bottom face of the flange and upper edge or circumference of the plug are preferably connected with a circumferential recess or groove section. Also, to facilitate insertion and removal of the stopper made from a rubber-like material, a lubricant, such as a silicone oil or aqueous glycerine solution, may be applied to the stopper.

DESCRIPTION OF THE DRAWINGS

In order that the invention may be readily carried into effect, it will now be described in greater detail, by way of example, with reference to the accompanying drawings, in which.

DESCRIPTION OF THE PREFERRED EMBODIMENTS

Figure 3:
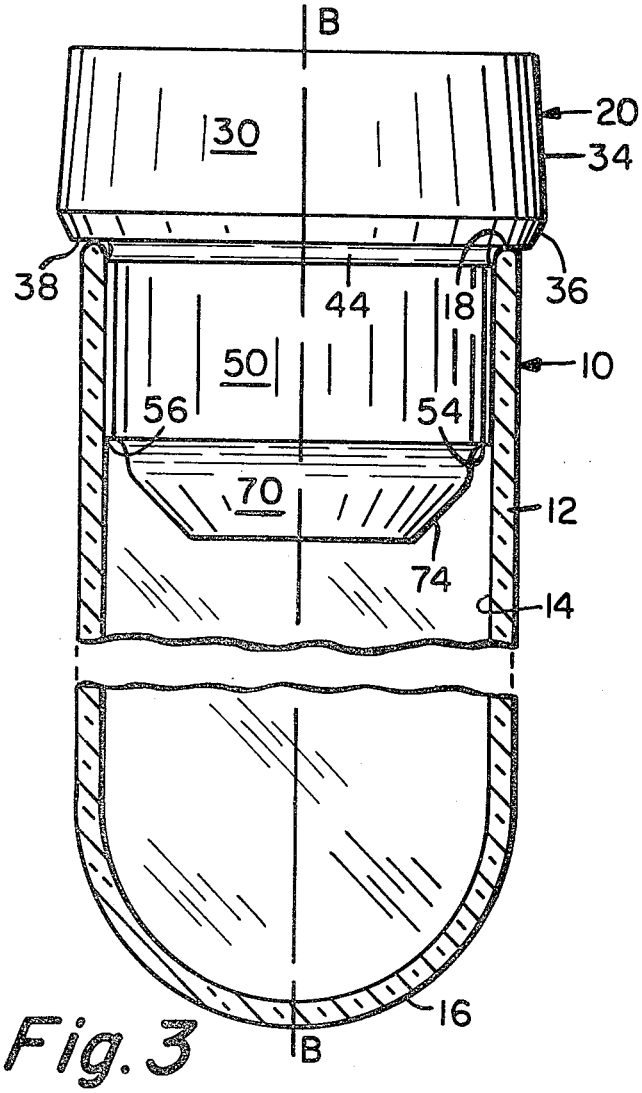
FIG. 3 is an elevational view partially in section of a blood-collecting and separating assembly of the present invention.

A conventional blood collecting and separating container or tube 10 as shown in FIG. 3 is formed of glass or other suitable material to hold a partial vacuum and to contain blood and includes a cylindrical wall 12 having a smooth inner surface or face 14 which is closed at one end 16 and open at the other end 18, with open end 18 lying in a plane normal to axis B—B of wall 12. Vacuum-tight sealing of open end 18 is accomplished by a stopper 20 formed from a flexible puncturable material, such as butyl rubber or other suitable material.

Figure 1:
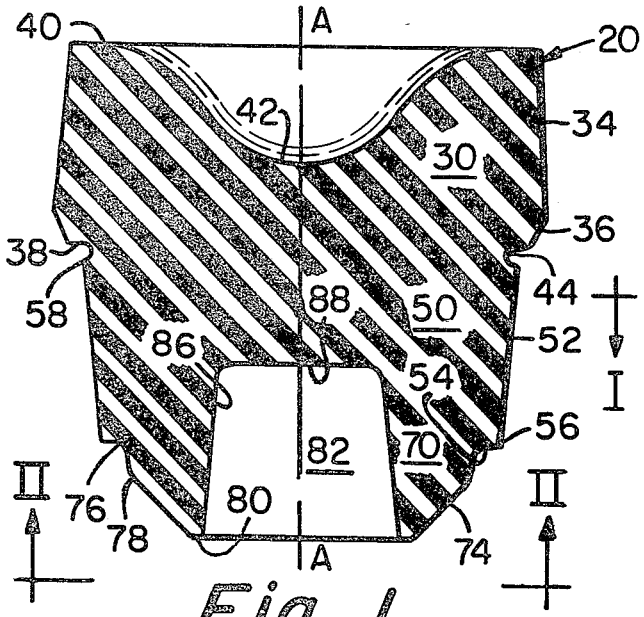
FIG. 1 is a cross-sectional view in elevation of an embodiment of the stopper according to the invention taken along line I—I of FIG. 2.
Figure 2:
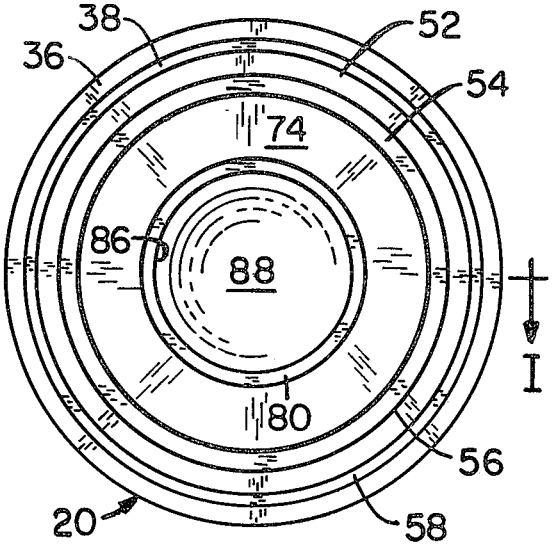
FIG. 2 is an axial or bottom plan view of the stopper as viewed along line II—II of FIG. 1.

The stopper, illustrated in FIGS. 1–3 is symmetrical about a centerline or axis A—A and includes a flange portion 30 for overlying open end 18, an integral plug portion 50 extending downwardly from flange portion 30 for forming a vacuum-tight and liquid-tight seal with the inner surface 14 of cylindrical wall 12, and an integral radially recessed nose portion 70, projecting downwardly from plug portion 50 for facilitating the flow of blood portions from the vicinity of the stopper toward container closed end 16. Flange portion 30 has a lateral face which may be formed by an upper frustoconical section 34 and a lower frustoconical section 36; a top or upper face 40 having an axial recess 42 therein; and a bottom annular face or band 38 lying in a plane which is normal to centerline or axis A—A of stopper 20.

Plug portion 50 includes a radially inwardly and downwardly tapered or frustoconical lateral face 52 depending from flange bottom surface or band 38, and a bottom annular face or band 54 lying in a plane normal to axis A—A and bounded by lateral face 52 along a lower edge 56 forming an outer circumference of band 54. Preferably, an annular recess or groove section 44 connects an inner circumference of the bottom face 38 of flange portion 50 with an upper edge 58 of plug lateral face 52. The upper edge 58 of plug lateral face 52 has a diameter sufficiently greater than the inner diameter of tube wall 12 to provide for a vacuum-tight seal between at least an upper portion of conical surface 52 and the inner surface 14 of tube wall 12. The lower edge 56 of plug portion 50 has a diameter greater than the inner diameter of tube wall 14 to form a liquid-tight seal therewith.

Nose portion 70 connects with and extends from an inner circumference of plug bottom annular face 54. Nose 70 has an outer face including an inwardly and downwardly beveled or tapered frustonical section 74 and an axial bottom-open cavity 82. The cavity 82 is formed in the underside of the nose portion 70 and extends upwardly through nose portion 70 and partially through plug portion 50. As shown in FIGS. 1–3, nose 70 includes a first inwardly rounded section 76 adjoining an inner circumference of plug portion annular bottom band 54 and a second rounded section 78 connecting a lower circumference of first rounded section 76 with an upper circumference of frustoconical section 74, thus in effect joining the frustoconical secstion 74 to annular bottom band 54 by means of a short cylindrical section with rounded ends.

Figure 4:
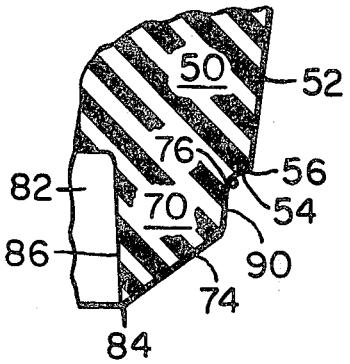
FIG. 4 is a fragmental elevational view in section of another embodiment of the stopper of the present invention.

As illustrated in FIG. 1, nose portion 70 may have an annular bottom face 80 normal to axis A—A into which axial cavity 82 is formed. Another embodiment, as depicted in FIG. 4, includes a nose portion 70 having an axial cavity 82 formed in the frustoconical section 74 of the nose, thus forming a sharp or acutely angled edge 84 at the mouth of the cavity. In both embodiments, cavity 82 is preferably defined by an inwardly and upwardly tapered or frustoconical lateral face or peripheral wall 86 and an upper face 88. To assure proper needle penetration, upper face 88 is preferably flat. Cavity 82 extends through nose portion 70 and through part of plug portion 50, that is, to a position above plug bottom band 54.

In the embodiment of stopper 20 illustrated in FIG. 4, the nose portion includes a cylindrical section 90 connecting the lower circumference of first rounded section 76 with frustoconical section 74. Also, the embodiment includes a nose portion having a more steeply inclined cavity lateral face 86 and a less steeply inclined nose portion conical face section 74.

By way of example, the following dimensions and angles are given to more specifically describe the stopper of the present invention. For a tube 10 having an inner diameter of about 0.543 inches, the plug portion 50 may have a major diameter at upper edge 58 of about 0.590 inches, minor diameter at lower edge 56 of about 0.550 inches, and a vertical length between edges 56 and 58 of about 0.240 inches. Groove section 44, in the form of a radiused recess, may have a width or diameter of about 0.020 to 0.025 inches. Annular bottom band 54 of plug portion 50 may have a radial width of about 0.030–0.055 inches. An angle included upwardly between the intersection of axis A—A with a line lying in frustoconical face section 74 of nose portion 70 and lying in a vertical plane intersecting axis A—A may range from 40° to 60°. An angle included between the intersection of axis A—A with a line lying in cavity frustoconical face 86 and in a vertical plane intersecting axis A—A ranging from about 15° to 40° has been found to be compatible with known angle-head and flat-out centrifugation.

If the stopper 20 is made from butyl rubber, the application of a slight amount of libricant to the stopper is desirable to facilitate insertion and removal of the stopper from an evacuated collecting and separating tube. Known commercially available silicone fluids or oils, such as manufactured by Dow Corning, or aqueous glycerine solutions have been found to be suitable lubricants. The silicone or glycerine treatment not only assures enough lubricity for the bottom edge of conical plug face to ease into the 90° departure angle with the tube wall after stopper insertion, but also gives added protection against cell or clot adherence to the stopper.

FIG. 3 shows the stopper 20 fully inserted into tube 10. The assembly is evacuated prior to stopper insertion and blood may be drawn into the assembly according to conventional venipuncture practice, such as with a double-ended needle device shown in U.S. Pat. No. 2,460,641 to Kleiner. The construction of the stopper is such that annular groove or recess section 44 permits tube open end 18 to abut, without obstruction against the flat bottom face or band 38 of flange 30. Due to the fact that tube open end 18 lies in a plane normal to the tube axis B—B and that plug bottom band 54 lies in a plane parallel to flange bottom band 38, plug bottom band 54 will also lie in a plane normal to axis B—B, thereby providing an angle of departure of about 90° between the plane of plug band 54 and vertical inner wall surface 14. That is, when fully assembled, plug band 54 is normal to wall face 14. Moreover, the unobstructed abuttment of the flange bottom band 38 against the tube open end 18, accomplished by means of groove section 38, assures squareness of seating and precludes cocking or separating of portions of edge 56 of bottom band 54 from adjacent tube wall portions, which would provide an acutely angular space for cells or other blood constituents to lodge.

The 90° angle of departure in conjunction with the spacing-apart of nose portion 70 by the width of plug bottom band 54 provide for freedom from ring-clog retention at the juncture of the stopper 20 and the tube inner wall 14. Any blood adhering to the stopper or tube wall in the vicinity of the juncture before centrifugation of the filled assembly readily flows from the annular band 54 upon centrifugation of the assembly.

Also, the downward and inward slope of frustoconical section 74 of nose portion 70 and the inward and upward slope of frustoconical lateral face 86 of plug bottom cavity 82 work in concert to provide a clot-free geometry in both angle-head and horizontal modes of centrifugation. Blood portions initially adhering within cavity 82 and between the outer surface of nose portion 70 and tube wall 14 readily flow during centrifugation down cavity lateral surface 86 and nose portion frustonocical section 74, respectively, and are slung from the stopper from near the bottom edge of cavity 82 toward the bottom of the tube. The frustonocical configuration of cavity lateral face 86 has been found to completely eliminate any concern of cellular retention on the cavity lateral face 86 resulting from centrifugal forces exerted in centrifuges having angle-head rotors.

Specifically, in a typical centrifuge having an angle-head rotor, the tube 10 is spun about an axis of rotation at an angle of about 35° between the axis B—B of the tube and the axis of rotation of the rotor. When positioned within an angle-head rotor, blood within the stopper bottom cavity is forced away from the axis of rotatin during centrifugation, and toward the outer sloped or tapered cavity wall. The slope of the cavity lateral face 86 is adapted to enhance flow from the outer half of the cavity and precludes the possibility of blood building up and drying on the cavity wall 86. The cleanliness of the stopper cavity is important, because subsequent to centrifugation, the stoppered tube (if it has a gel-like barrier, as described above) may be rested in a horizontal position, thus bringing the separated serum into contact with the stopper bottom cavity 82.

Furthermore the downwardly and inwardly tapered or frustoconical shape of plug portion 50 in conjunction with the construction of the upwardly and inwardly tapered bottom cavity 82 extending into a portion of plug portion 50 (that is, at a position above bottom annular band 54) provides for a stopper which can be easily inserted into and removed from the tube open end 18, while yet providing excellent vacuum retention at or near upper edge 58 and a fluid-tight seal at the lower edge 56 of the plug portion 50 of the stopper.

The invention is not restricted to the examples described but also includes various modifications and constructions for example, a stopper in which the lateral radially downwardly tapered face 52 of the plug portion 50 is slightly outwardly curved or bulged, a stopper in which the bottom cavity 82 formed axially the nose and plug portions 70 and 50 is generally semispherical in shape, a stopper the nose portion of which includes an outer inwardly beveled section 74 having a slightly curved cross-section, or a stopper the flange 30 of which includes a cylindrical section overlapping the tube open end 18 and extending downwardly over an upper end portion the outer surface of tube wall 12.

I claim:

1. A stopper assembly for use in combination with a tubular blood collection and separation container having cylindrical sidewalls defining a longitudinal axis and provided with an open end portion comprising, a removable stopper including a flange portion having means for engaging said open end portion of said container in a plane substantially normal to the longitudinal axis of the cylindrical sidewalls thereof, a frustoconical plug portion integrally depending from said flange portion having lateral face means of greater diameter than the inner diameter of said sidewalls for sealingly engaging said sidewalls in a fluid and vacuum tight relationship, said plug portion tapering inwardly away from said flange portion and terminating at an annular band extending radially inwardly from said lateral face means in a plane lying normal to said longitudinal axis, a nose portion depending from said plug portion and bounded at its juncture with said plug portion by an inner circumference of said annular band, said nose portion including a lateral face of a frustoconical shape which tapers inwardly in a direction projecting away from said annular band and an inner face of a generally frustoconical shape which tapers inwardly within said nose and plug portions in a direction projecting toward said flange portion, and said annular band providing means for spacing said nose portion radially inwardly away from the inner surface of said sidewalls to thereby facilitate during centrifugation the flow of blood components away from said sidewalls and across said annular band toward said frustononical lateral face of said nose portion.

2. The stopper of claim 1 further comprising a circumferential groove section connecting said plug portion with said flange portion.

* * * * *

UNITED STATES PATENT OFFICE

CERTIFICATE OF CORRECTION

PATENT NO. : 3,958,572

DATED : May 25, 1976

INVENTOR(S) : Creighton M. Lawhead

It is certified that error appears in the above-identified patent and that said Letters Patent are hereby corrected as shown below:

Column 1, line 52, "onthe" should read --on the--; Column 3, line 33, "hand" should read --band--; Column 4, line 56, "frustonical" should read --frustoconical--; Column 4, line 66, "secstion" should read --section--; Column 5, line 44, "libricant" should read --lubricant--; Column 6, line 13, "ring-clog" should read --ring-clot--; Column 6, lines 27 and 28, "frustonocical" should read --frustoconical--; Column 6, line 41, "rotatin" should read --rotation--; Column 8, line 16, "frustononical" should read --frustoconical--.

Signed and Sealed this

Seventh Day of September 1976

[SEAL]

*Attest:*

RUTH C. MASON
*Attesting Officer*

C. MARSHALL DANN
*Commissioner of Patents and Trademarks*